US005931535A

United States Patent [19]

Sweet

[11] Patent Number: 5,931,535

[45] Date of Patent: Aug. 3, 1999

[54] CLINICAL CARE RECLINER

[75] Inventor: Dan R. Sweet, St. Louis, Mo.

[73] Assignee: Dacor Manufacturing Company, Inc., Fenton, Mo.

[21] Appl. No.: 09/016,864

[22] Filed: Jan. 30, 1998

[51] Int. Cl.[6] ..... A47C 1/024

[52] U.S. Cl. ..... 297/354.13; 297/68; 297/411.26

[58] Field of Search ..... 297/68, 145, 155, 297/188.15, 354.13, 362.13, 411.26, 411.27

[56] References Cited

U.S. PATENT DOCUMENTS

| | | | |
|---|---|---|---|
| 1,649,761 | 11/1927 | Vinegrad | 297/145 |
| 1,710,820 | 4/1929 | Hackney | 297/354.13 X |
| 1,726,109 | 8/1929 | Jost | 297/145 |
| 2,240,204 | 4/1941 | Bell . | |
| 2,591,911 | 4/1952 | Block . | |
| 2,605,820 | 8/1952 | Powellek . | |
| 2,741,300 | 4/1956 | Tubbs et al. . | |
| 2,764,224 | 9/1956 | Maurer . | |
| 3,169,035 | 2/1965 | Fletcher | 297/85 |
| 3,174,800 | 3/1965 | Jennings | 297/411.27 |
| 3,245,090 | 4/1966 | Slimmer | 4/134 |
| 3,897,973 | 8/1975 | Long et al. | 297/75 |
| 4,339,013 | 7/1982 | Weigt | 297/354.13 X |
| 4,632,450 | 12/1986 | Holdt | 297/84 |
| 4,896,917 | 1/1990 | Enevoldson | 297/217 |
| 5,007,679 | 4/1991 | Mizelle | 297/374 |
| 5,263,768 | 11/1993 | Scheulderman | 297/362.13 |

FOREIGN PATENT DOCUMENTS

| | | | |
|---|---|---|---|
| 2414953 | 10/1975 | Germany | 297/68 |

OTHER PUBLICATIONS

Medcor Reclining Chairs, Care Cliner & Care Cliner XL Brochure.

Lumex Specialty Seating Brochure, © 1995.

Lumex 565T Tilt–In–Space Preferred Care Recliner Brochure, © 1995.

Lumex Clinical Care Recliners Brochure, © 1997.

*Primary Examiner*—Peter R. Brown

*Attorney, Agent, or Firm*—Grace J. Fishel

[57] ABSTRACT

A clinical care recliner with a support frame, a lazy-tong linkage, a seat, sidearms, back-rest and a leg-rest. The sidearms laterally confine the patient and are removable so that any spilled body fluids between the seat and the sidewall can be cleaned away. The removable sidearms also facilitate lateral transfer of a patient into and out of the recliner without lifting. The back-rest has a swing-out support for stabilizing the back-rest in Trendelenburg position.

10 Claims, 4 Drawing Sheets

CLINICAL CARE RECLINER

BACKGROUND OF THE INVENTION

1. Field of the Invention

The present invention relates to a clinical care recliner with quick Trendelenburg positioning and removable sidearms to facilitate cleaning of biohazards and lateral transfer of a patient.

2. Brief Description of the Prior Art

A clinical care recliner should be designed to meet the many needs of patients in a clinical care environment such as dialysis, ICU, CCU and same day surgery. Ideally a clinical care recliner should be useful for treatment, procedures and transport, preferably with quick Trendelenburg positioning for emergency treatment of shock or cardiac arrest. A clinical care recliner should have sidearms for patient comfort and be readily cleanable as blood, vomit and other biohazardous body fluids are frequently spilled in clinical care use.

There are clinical care recliners with sidearms that function as treatment, procedures and transport recliners and that have Trendelenburg positioning. Such chairs have vinyl sidearms and cushions that can be wiped down. The cushions are not usually removed unless they are being replaced and the frame is not washed.

Dried biohazardous body fluids collect in the space between the bottom seat cushion and the sidearms. This space is difficult to reach with a cleaning cloth or sponge and it is impossible to check whether the wiping has been complete. If a patient sitting in a clinical care recliner that has been in use for some time slides his or her hand between the cushion and the sidearm of the chair, there is a chance that the patient will come into contact with dried body fluids resulting in the transfer of an infectious disease. This risk, however, has not been fully appreciated in clinical care recliners as the contaminating material in the crack between the cushion and the sidearms is out of sight.

BRIEF SUMMARY OF THE INVENTION

In view of the above, it is an object of the present invention to provide a recliner with sidearms for laterally confining a patient adapted for use in a clinical care environment. It is another object to provide a clinical care recliner with sidearms that are removable for cleaning and for laterally sliding a patient on the seat, rather than by lifting the patient into the recliner. It is also an object to provide a clinical care recliner with quick Trendelenburg positioning in which the back-rest is stabilized. Other objects and features of the invention will be in part apparent and in part pointed out hereinafter.

In accordance with the invention, a clinical care recliner has a support frame, a lazy-tong linkage, a seat, sidearms, a back-rest and a leg-rest. The frame has front and rear stretchers interconnected by right and left side rails. The right and left side rails are mounted on front and rear legs with the legs extending above and below the side rails.

The lazy-tong linkage is mounted on the front and rear stretchers and the seat and leg-rest are pivotally attached to the lazy-tong linkage. The lazy-tong linkages tilts the seat and extends the leg-rest between upright and recline positions, while the back-rest is pivotally attached to the seat with a lockable, manually operable spring for positioning the back between upright and Trendelenburg position.

The sidearms confine a patient laterally and have depending front and rear legs which are connected with the front and rear legs on each side of the frame with a spigot-and-socket joint such that the sidearms can be removed.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
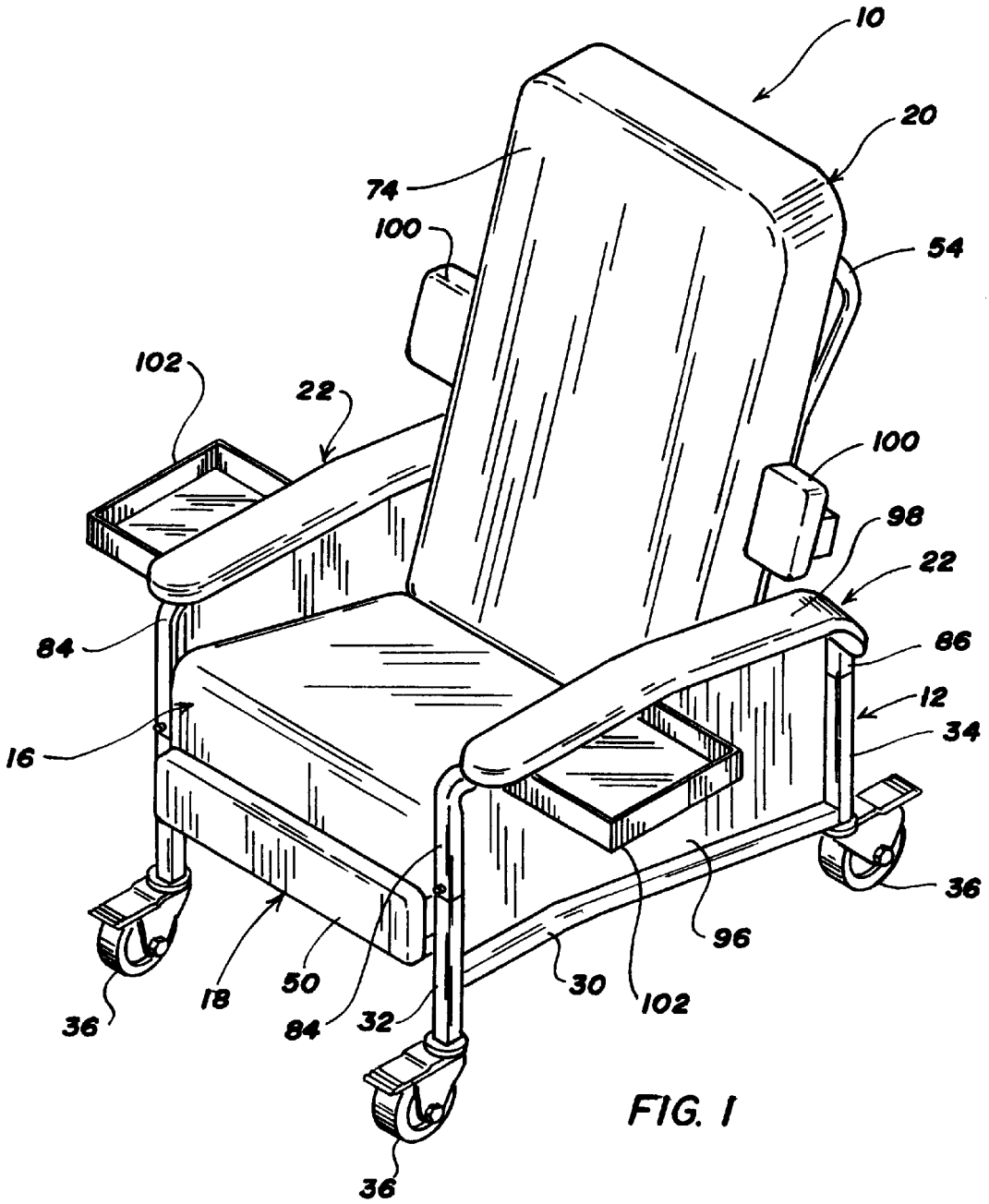
FIG. 1 is a perspective view of a clinical care recliner in accordance with the present invention.

Referring to the drawings more particularly by reference number, reference numeral 10 refers to a clinical care recliner in accordance with the present invention. In major part, recliner 10 includes a support frame 12, a lazy-tong linkage 14, a seat 16, a leg-rest 18, a back-rest 20 and removable sidearms 22.

Frame 12 has front and rear stretchers 24, 26 and right and left side rails 28, 30, respectively. The side rails are mounted on front and rear legs 32, 34, the legs extending above and below the side rails. The lower end of legs 32, 34 are mounted on casters 36, the front wheels swiveling and the rear wheels swivel/locking, both front and rear casters having brakes. By locking the rear wheels in line with the direction in which the recliner is pushed, tracking is improved, while allowing the rear wheels to swivel permits the caregiver to easily maneuver the recliner into position.

Figure 2:
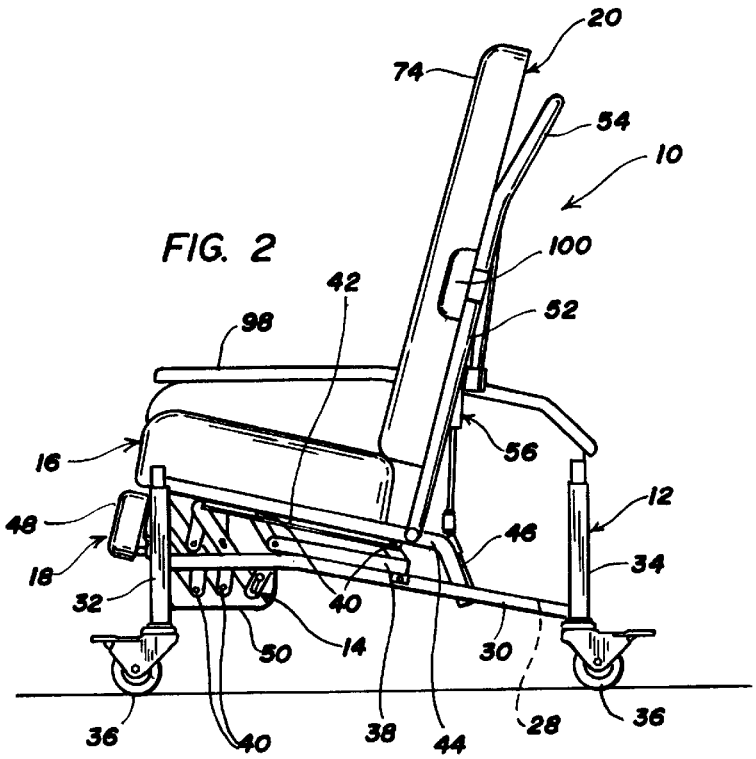
FIG. 2 is a side view of the recliner with a left sidearm removed, illustrating a lazy-tong linkage in retracted position and a back-rest in upright position.
Figure 3:
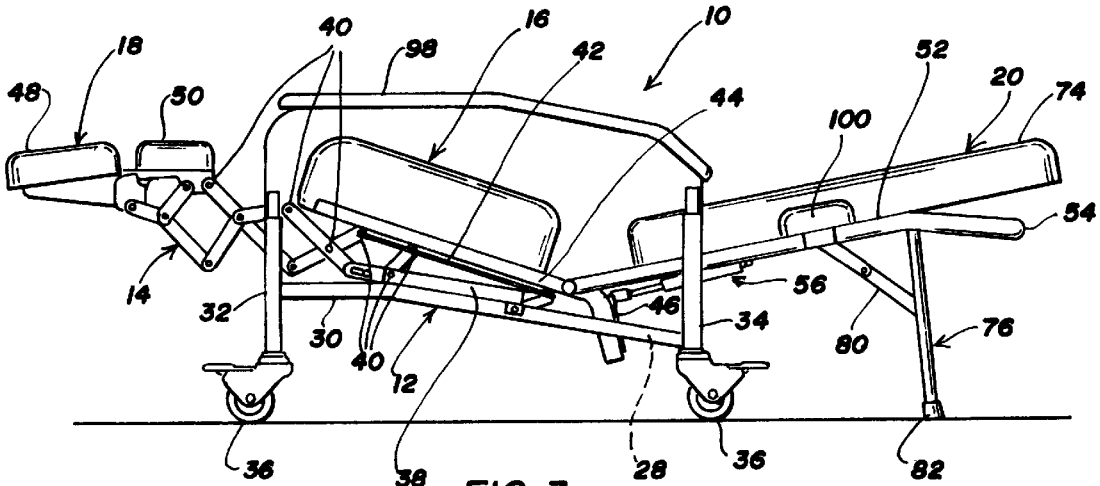
FIG. 3 is a side view like FIG. 2 but with the lazy-tong linkage extended and the back-rest in Trendelenburg position stabilized with a support.

Lazy-tong linkage 14 comprises a pair of laterally spaced apart, extendible and retractable systems of links, one of which is shown in its retracted position in FIG. 2 and in its extended position in FIG. 3. Lazy-tong linkage 14 is pivotally mounted on front and rear stretchers 24, 26, through opposing, L-shaped brackets 38 transverse to the stretchers and spaced inboard of side rails 28, 30. The rearward endmost of the links are pivotally connected on pintels 40 to a support bracket 42 attached to the lower side edge of seat 16. A pair of curved frame members 44 are also attached to seat 16 outboard of support bracket 42. As seen in FIGS. 2 and 3, viewing recliner 10 from the side, curved frame members 44 extend along the lower side edge of seat 16, beyond the rear edge and are then angled downward. The rear end of curved frame members 44 are joined together by a cross-member 46. The forward endmost of the links are pivotally connected on pintels 40 to leg-rest 18, the leg-rest 18 including foot-rest and knee-rest portions 48, 50, respectively.

Tilting of seat 16 and rotation of leg-rest 18 is accomplished through the use of a conventional arrangement of links of different lengths joined together unsymmetrically. In extended position, leg-rest 18 is generally horizontal, while seat 16 is rotated backward and tilted upward more steeply. In retracted position, seat 16 is rotated forward and the angle of tilt reduced while knee-rest 50 is brought to vertical position, resting against the front face of the recliner, and foot-rest 48 is swung under the seat.

Back-rest 20 includes a generally U-shaped support frame 52, the legs of which are pivoted on curved frame members 44 at the rear of seat 16. The bight of support frame 52 angles away from back-rest 20 forming a transverse handle 54 for pushing the chair on casters 36 and for pivoting the back-rest with respect to seat 16. A manually operable gas spring 56 is provided for positioning and holding back-rest 20 at a fixed inclination with respect to seat 16 between a first, full upright (FIG. 2) and a second, generally horizontal, Trendelenburg (FIG. 3) position. Within these limits, gas spring 56 provides infinite positioning.

Figure 5:
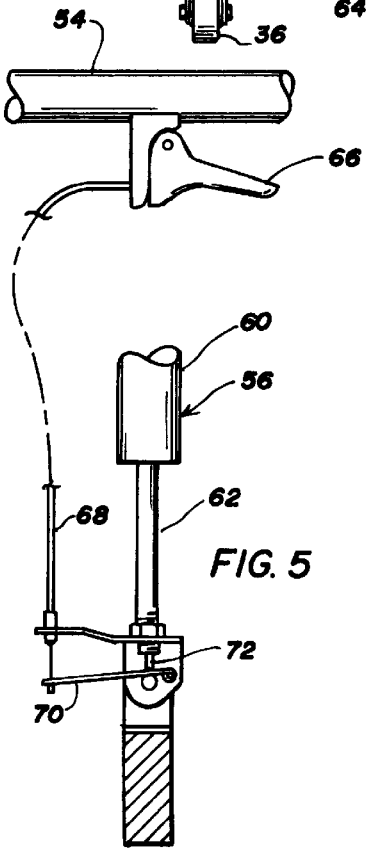
FIG. 5 is an enlarged detail, partly in section, showing a manually operable gas spring, taken along line 5—5 in FIG. 4 when the back-rest is in upright position.
Figure 6:
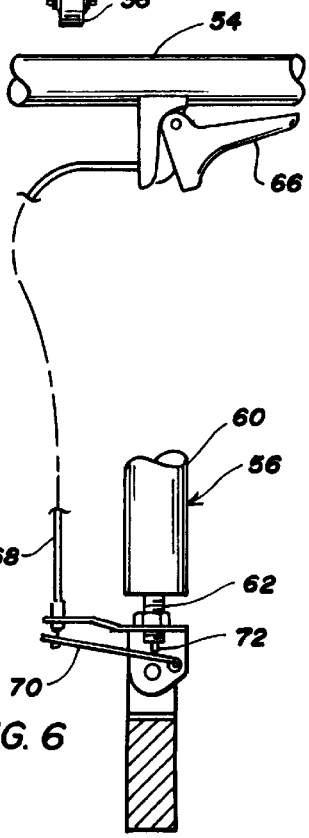
FIG. 6 is a view like FIG. 5 showing the gas spring when the back-rest is in Trendelenburg position.

A horizontal brace 58 is provided on the back face of back-rest 20. Manually operable gas spring 56 includes a pressure tube 60 and a piston rod 62, which as shown in the drawings, are connected with a clevis 64 through connection fittings to brace 58 and cross-member 46. As shown in FIGS. 5–6, when an actuator 66 is squeezed, a cable 68 is pulled causing a spring loaded finger 70 to depress an operator 72 allowing piston rod 62 to retract and back-rest 20 to recline. By controlling the amount that piston rod 62 retracts, gas spring 56 provides a releasable locking mechanism for holding back-rest 20 at a fixed inclination with respect to seat 16 and, in case of an emergency, for quickly bringing the recliner to Trendelenburg position. In which pose, seat 16 is tilted and leg-rest 18 extended such that it is at least about as high as, i.e., within about three inches of being as high as, a headrest portion 74 of back-rest 20. In this posture, a patient's blood is pulled by gravity towards the heart for recirculation, needed to counteract shock caused by excessive dilation of the blood vessels or inadequate pumping action of the heart as a result of cardiac arrest, pulmonary embolism, failure of a heart valve (particularly an artificial valve), or an irregular heartbeat, any of which events is a common occurrence in a clinical care environment.

Figure 4:
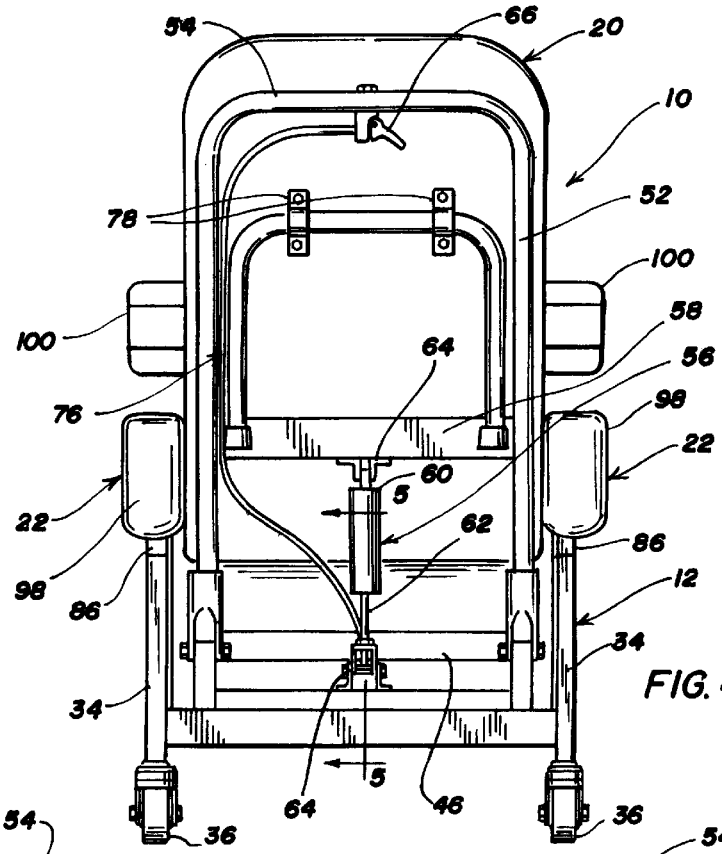
FIG. 4 is a rear view of the recliner with the back-rest in upright position.

A fold-out support 76 is preferably provided for stabilizing back-rest 20 in Trendelenburg position as shown in FIG. 3 so that a caregiver may give CPR or perform other emergency procedures without removing the patient from the recliner, or having the recliner tip. In the particular embodiment illustrated in the drawings, support 76 is a U-shaped member, the bight of which is journaled to back-rest 20 with a pair of curved straps 78. When back-rest 20 is in its upright position as shown in FIGS. 2 and 4, support 76 hangs vertically against the back. When back-rest 20 is in Trendelenburg position as shown in FIG. 3, support 76 swings away from the back-rest, as under force of gravity, until stopped in generally vertical position with respect to the floor by inclined, folding strut 80. The legs of U-shaped member 76 may be provided with crutch tips 82 to prevent slippage.

Figure 10:
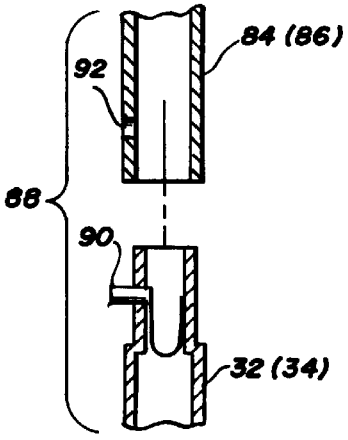
Figure 7:
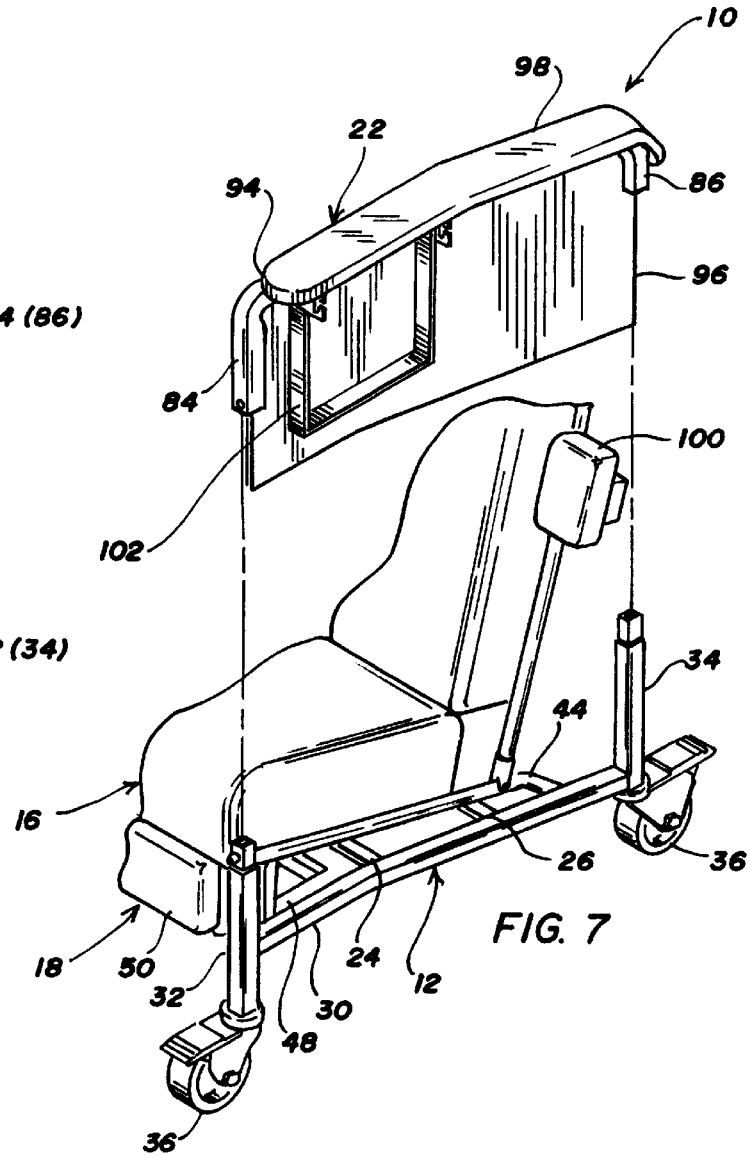
FIG. 7 is a perspective view of the recliner, partly broken away, with the left sidearm removed and with the lazy-tong linkage omitted to better show front and rear stretchers.

Sidearms 22 have depending front and rear legs 84, 86, respectively, which releasably mate with front and rear legs 32, 34 of frame 12. As best seen in FIG. 10, a spigot-and-socket joint 88 is provided for releasably mating the legs of the sidearms with the legs of the frame. With continuing reference to FIG. 10, legs 32, 34 are reduced in size at the upper end forming a spigot which is received in the lower end of legs 84, 86 which form a socket. It will be appreciated that these elements may be reversed and that other releasable mating joints may be used. A spring biased pin 90 may be provided in the spigot, for releasable receipt in a hole 92 in the socket at all joints, or as shown in FIG. 7, just at the front of the recliner.

Front and rear legs 84, 86 are part of a U-shaped frame and are interconnected by a top rail 94. A side panel 96 is mounted between front and rear legs 84, 86 and top rail 94. Side panel 96 is longer than front and rear legs 84, 86 so that when sidearms 22 are on frame 12, side panels 96 border the side edges of seat 16, confining the patient laterally, with the lower end of the side panels 96 resting on stretchers 24, 26. An arm-rest 98 overhangs top rail 94 and slopes towards the rear of the recliner to provide an elbow support in full recline. Other arm-rests 100 may be provided on opposite sides of back-rest 20 for support of a patient's upper arm.

Figure 8:
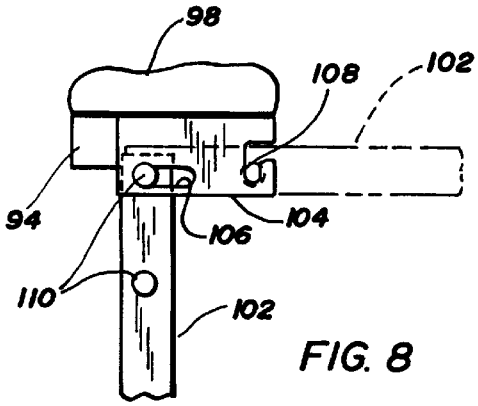
FIG. 8 is a front view, in enlarged detail, of the way in which a dropleaf table attaches to the sidearm with the table shown in stowed, vertical position in full lines and in use, horizontal position in broken lines.
Figure 9:
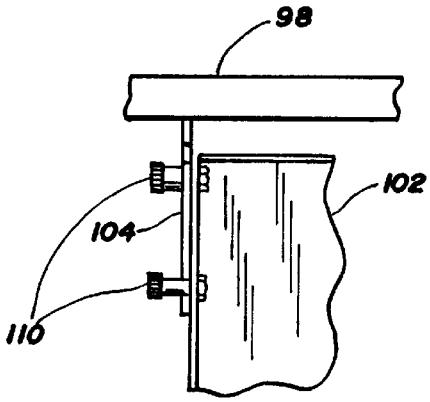
FIG. 9 is a top view, in enlarged detail, of the dropleaf table attached to the sidearm in use position; and, FIG. 10 is a cross-section, in enlarged detail of a spigot-and-socket joint with a spring biased pin for releasably securing the joint.

A dropleaf table 102 is hinged to sidearm 22 as shown in FIGS. 1 and 7–9. Table 102 can be raised to a horizontal position or lowered to a vertical stored position to suit the needs or convenience of the patient or caregiver. As best seen in FIG. 8, a pair of brackets 104 are attached to the underside of each arm-rest 98. Brackets 104 have a closed, horizontal, elongated slot 106 and a vertical slot 108 which is open at its upper end. Table 102 has a pair of pintels 110 for receipt in slots 106, 108. When table is in stored position as shown in full lines in FIG. 8, the tray hangs from brackets 104 by the upper pintels. In the use position, tray is supported by both pintels 110, the lower one of which is seated in open slot 108 as shown in FIG. 9 and in broken lines in FIG. 8.

Seat 16, back-rest 20, leg-rest 18 and arm-rests 98, 100 are preferably covered with plastic covered cushions that can be easily washed and quickly dried, some or all of which may be contoured for additional patient comfort.

In a clinical care environment, recliner 10 can function as a treatment, procedures and transport recliner. It can be quickly brought into Trendelenburg position, fold-out support 76 giving the recliner greater stability for emergency procedures such as CPR. The removable sidearms facilitate the lateral transfer of comatose, weak or paralyzed persons into and out of recliner. More importantly, however, removable sidearms 22 expose any dried body fluids harbored in the space between the sidearms and the side edges of seat 16. Once exposed to view, the harmful materials can be easily cleaned away, removing a heretofore unrecognized biohazard. Removal of biohazards is particularly important in a clinical care environment as the physical resistance of a typical recliner user is already challenged.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A clinical care recliner comprising a support frame, a lazy-tong linkage, a seat, sidearms, a back-rest and a leg-rest, said frame having front and rear stretchers interconnected by right and left side rails, said right and left side rails mounted on front and rear legs, said legs extending above and below the side rails, said lazy-tong linkage mounted on the front and rear stretchers, said seat and leg-rest pivotally attached to the lazy-tong linkage, said lazy-tong linkage tilting the seat and extending the leg-rest between upright and recline positions, said back-rest pivotally attached to the seat with a lockable, manually operable spring for positioning the back between upright and Trendelenburg position, said sidearms having depending front and rear legs, and a releasable mating joint for connecting the front and rear legs of each sidearm with the front and rear legs on each side of the frame whereby the sidearm can be easily removed for cleaning and for facilitating lateral transfer of a patient into and out of the recliner without lifting.

2. The recliner of claim 1 where the releasable joint is a spigot-and-socket joint.

3. A clinical care recliner comprising a support frame, a lazy-tong linkage, a seat, sidearms, a back-rest and a leg-rest, said frame having front and rear stretchers interconnected by right and left side rails, said right and left side rails mounted on front and rear legs, said legs extending above and below the side rails, said lazy-tong linkage mounted on the front and rear stretchers, said seat and leg-rest pivotally attached to the lazy-tong linkage, said lazy-tong linkage tilting the seat and extending the leg-rest between upright and recline positions, said back-rest pivotally attached to the seat with a lockable, manually operable gas spring for positioning the back between upright and Trendelenburg position, said back-rest having a fold-out support for stabilizing the back-rest in Trendelenburg position, and said sidearms having depending front and rear legs, a spigot-and-socket joint for connecting the front and rear legs of each sidearm with the front and rear legs on each side of the frame whereby the sidearm can be easily removed for cleaning and for facilitating lateral transfer of a patient into and out of the recliner without lifting.

4. The recliner of claim 3 where the fold-out support is adapted to swing away from the back-rest under force of gravity when the back-rest is brought into Trendelenburg position until stopped in generally vertical position by an inclined folding strut.

5. The recliner of claim 3 wherein the front and rear legs of the sidearm are interconnected by a top rail forming a U-shaped frame, a side panel mounted between the front and rear legs and the top rail, said side panel being longer than the front and rear legs so that when the sidearms are on the frame, the side panel bordering the seat and confining a patient laterally.

6. The recliner of claim 5 where the spigots are formed on the front and rear legs of the frame and mating sockets are formed on the front and rear legs of the sidearms, a spring biased pin is provided for releasable receipt in a hole in the mating socket.

7. The recliner of claim 6 wherein the seat is supported on a pair of curved frame members and wherein the back-rest has a U-shaped support frame, the legs of which are pivoted on the curved frame members at the rear of the seat.

8. The recliner of claim 7 wherein the legs of the frame are mounted on casters.

9. The recliner of claim 8 wherein a bight of the U-shaped support frame is angled away from the back-rest forming a transverse handle for pushing the recliner on the casters.

10. The recliner of claim 9 wherein a dropleaf table is hinged to each sidearm, said dropleaf table movable between a raised horizontal, in-use position and a lowered vertical, stored position.

* * * * *